US005197112A

United States Patent [19]

Cameron

[11] Patent Number: 5,197,112

[45] Date of Patent: Mar. 23, 1993

[54] FIXED VOLUME PTC AIR HEATER WITH HEAT OUTPUT ADJUSTED BY A DAMPER CONTROLLING AIR FLOW OVER THE PTC ELEMENT

[76] Inventor: David M. Cameron, 1003 Black Oak Ct., Apex, N.C. 27502

[21] Appl. No.: 633,137

[22] Filed: Dec. 24, 1990

[51] Int. Cl.[5] ..... H05B 3/14; F24H 3/04; F28F 27/02; H01C 7/02

[52] U.S. Cl. ..... 392/360; 165/103; 165/122; 219/505; 251/251; 251/253; 392/363; 392/368; 392/379; 392/383

[58] Field of Search ..... 392/347-376, 392/379-385; 219/205, 505; 251/251, 253; 165/103, 121, 122

[56] References Cited

U.S. PATENT DOCUMENTS

| | | | |
|---|---|---|---|
| 1,889,588 | 11/1932 | Anderson | 165/103 |
| 2,914,648 | 11/1959 | Allander | 392/360 |
| 3,252,509 | 5/1966 | Keegan | 165/103 |
| 3,394,755 | 7/1968 | Morrison | 165/103 |
| 4,218,608 | 8/1980 | Maroney | 392/385 X |
| 4,316,077 | 2/1982 | Carlson | 392/385 |
| 4,459,466 | 7/1984 | Nakagawa et al. | 392/360 X |
| 5,057,672 | 10/1991 | Bohlender et al. | 219/505 X |

FOREIGN PATENT DOCUMENTS

| | | | |
|---|---|---|---|
| 173655 | 10/1984 | Japan | 392/365 |
| 717612 | 3/1952 | United Kingdom | 219/205 |

*Primary Examiner*—Anthony Bartis
*Attorney, Agent, or Firm*—Lee, Mann, Smith, McWilliams, Sweeney & Ohlson

[57] ABSTRACT

An electric forced air heating device using PTC elements for heating and having a fixed volume of airflow established by a blower driven at a constant rate. A pair of parallel air paths are established in the device, with one air path having the PTC elements fixedly located therein. A laterally movable damper is used to control airflow through the two air paths, and is positioned proximate the PTC elements a fixed distance therefrom so that as the damper is shifted, airflow proportionally increases through one of the air paths and proportionally decreases through the other air path to control the heat output of the PTC elements. The energization of the PTC elements and blower is controlled by a switch activated by movement of the damper.

16 Claims, 3 Drawing Sheets

FIXED VOLUME PTC AIR HEATER WITH HEAT OUTPUT ADJUSTED BY A DAMPER CONTROLLING AIR FLOW OVER THE PTC ELEMENT

BACKGROUND OF THE INVENTION

This invention relates to air heating devices, and in particular to an electric air heater having a fixed volume airflow with damper control to determine the heat output.

Conventional, electric air heaters share many of the same concepts, such as:

1. Almost all heaters employ Nichrome type heating elements in one form or another, which are heated to extreme temperatures. Some such heaters used forced air and others use natural draft or convection for heat transfer.

2. Almost all conventional heaters utilize electrical or electro-mechanical switching to deenergize the heating elements for control of heat discharged. Such controls normally take the form of thermostats or similar elements.

3. Whenever an abnormal condition arises, such as when a motor fails to deliver air or air discharge is physically blocked, almost all heating devices depend on some kind of thermo-limiting device to deactivate the heating elements to prevent a fire or electrical breakdown. This can be accomplished through the use of limit controls or some other form of thermally active limiting device. Often such controls or devices become very complex, even to the extent of employing secondary backup controls in the event that the primary control also fails to function.

4. Most conventional air heaters that are permanently installed are comprised of assemblies which must be fitted together to form the final device, from simple enclosures with cover plates, to segmented devices which are joined on site during installation. As a result, some devices are simple to install while others are complex, requiring skilled, knowledgeable installers for proper installation.

Conventional electrical air heating appliances use heat sources which can often reach temperatures as high as 1600° F., well above the combustible limit of most nonmetallic materials. The safe operation of such heaters is dependent on the operation of limit devices which turn off the heating elements during an abnormal situation. In contrast, in conventional PTC (positive temperature coefficient) heaters, the possibility of overheating and fire is not present. PTC elements are self-limiting as far as temperature of the elements. This self-limiting phenomena is the function of the physical chemistry of the doped ceramic material of which the PTC element is made.

The typical PTC element has an internal fixed value of resistance based on a given temperature. As the temperature rises or falls, so does the resistance of the PTC element. Typically, at around 340° F., the resistance of an element rises to a point to completely eliminate the flow of current through the element, thus stopping any further temperature rise of the element. This self-limiting feature will avoid an overheating condition (and consequential possible fire), and is the primary difference between a conventional heating source that employs wire heating elements and one which employs PTC elements.

SUMMARY OF THE INVENTION

The invention is directed to an electric air heating device which comprises a heat transfer body, and means for inletting air into the heat transfer body and means for outletting air from the heat transfer body. Locating within the body is heat transfer means comprising a pair of separate air paths, a PTC heating element located in one of the air paths, and means for controlling airflow through the air paths, the airflow controlling means including an adjustable regulator which, when adjusted, increases airflow in one of the two air paths and decreases airflow in the other of the air paths. For moving air through the heat transfer body, an appropriate means is provided for supplying air to the separate air paths.

In accordance with the preferred form of the invention, the heat transfer body is mounted in a housing which, as is conventional, is normally mounted in a wall, if the device is small enough, or is mounted in a stand-alone orientation with heat being ducted to remote locations. When the device is wall mounted, means is provided for spacing the heat transfer body from the housing, the means preferably comprising a series of spaced, insulative isolation pads located between the body and the housing.

The PTC heating means comprises a plurality of PTC elements, the number of elements depending on the design capacity of the heating device. The adjustable regulator, in the preferred form of the invention, comprises a horizontal damper, with an arm extending from the damper for adjustment. The damper extends over the air paths, which are located in a fore-and-aft relationship. The damper is mounted for lateral movement from a first position preventing airflow in one air path and permitting full airflow in the other air path to a second position preventing airflow in the second air path and permitting full airflow in the first air path. The arm is slideably mounted on the damper on a pair of guide posts extending from the damper through a slot in the arm such that transverse movement of the arm creates the lateral fore-and-aft movement of the damper.

When the damper is fully closed over the air path carrying the PTC heating elements, the elements are deenergized. To accomplish this result, it is preferred that an electrical switch for the elements be located adjacent the damper arm and be engaged by the damper arm when the damper is closed in order to deenergize the elements.

Preferably, for supplying air, the invention includes a scroll blower. The blower is driven at a constant rate for establishing a fixed volume of airflow through the body. By judicious adjustment of the damper, the heat exiting the heating device can be very closely controlled.

In a wall-mounted orientation, the invention includes an air grill for the air inlet and an air grill for the air outlet. The inlet grill includes air filter media to remove any contaminants from the air before entering the heat transfer body.

BRIEF DESCRIPTION OF THE DRAWINGS

The invention is described in greater detail in the following description of an example embodying the best mode of the invention, taken in conjunction with the drawings, in which.

DESCRIPTION OF AN EXAMPLE EMBODYING THE BEST MODE OF THE INVENTION

Figure 1:
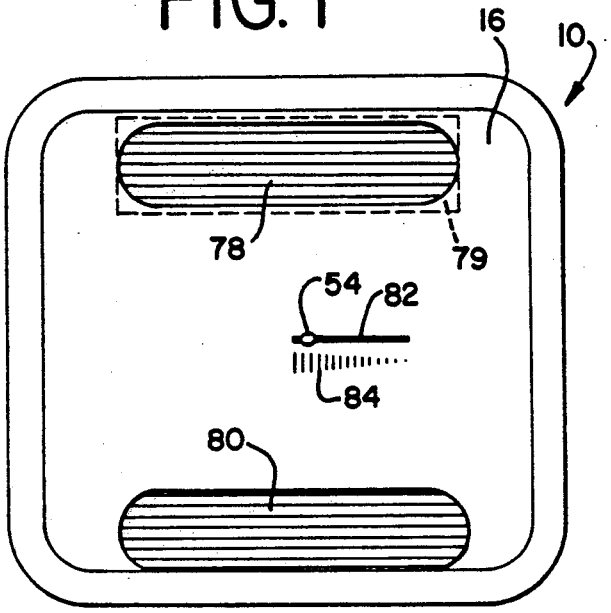
FIG. 1 is a front elevational illustration of an electric air heating device according to the invention.

The present invention utilizes PTC heating elements as a heat source. A PTC element is a solid state thermally sensitive resistor with fixed tolerances based on temperature. When a voltage potential is applied, the current, internal resistance and ultimate power of the PTC element are proportional to the ambient temperature to which the material of the PTC element is exposed. The PTC element is self-limiting, in that at a maximum fixed temperature of about 340° F., the element draws little or no power. Only as the core temperature of the element is reduced below this fixed point does the power again rise, thus increasing the heat output.

The present invention utilizes airflow to control temperature output. As the airflow over the PTC elements is increased, the core temperature of the elements falls, producing a drop in internal resistance which causes more current to flow, in turn raising the core temperature and consuming more electrical power. The temperature output is thus increased. Conversely, a reduction in temperature output is obtained by reducing the airflow over the PTC elements which consequently increases internal resistance, reducing current flow and therefore consuming less power. The invention is therefore inherently self-limiting, in that never can the PTC heating elements rise to a temperature that would be anywhere near the combustion limit of adjacent materials, such as wood structural members, or fabrics or paper. Even so, the invention employs two basic elements, an outer housing and the heater unit itself, with the heater unit being spaced from the outer housing.

An air heating device according to the invention is generally designated at 10 in the drawing figures. It comprises an outer housing 12 and a heater or heat transfer body 14 which is mounted in the housing 12. An ornamental cover 16 is used to provide an aesthetically pleasing finish for the air heating device 10 when installed. For the purposes of description, the front of the air heating device 10 is designated at 18, although such terminology is relative, depending on the configuration of the air heating device 10 and its installation.

The heat transfer body 14 is mounted in and spaced from the housing 12 with several isolation pads 20, which may be silicone sponges or similar materials. Not only do the pads 20 provide heat insulation, but also noise isolation, as well. Single top and bottom screws (not illustrated) may be employed for securing the heat transfer body 14 within the housing 12.

Figure 7:
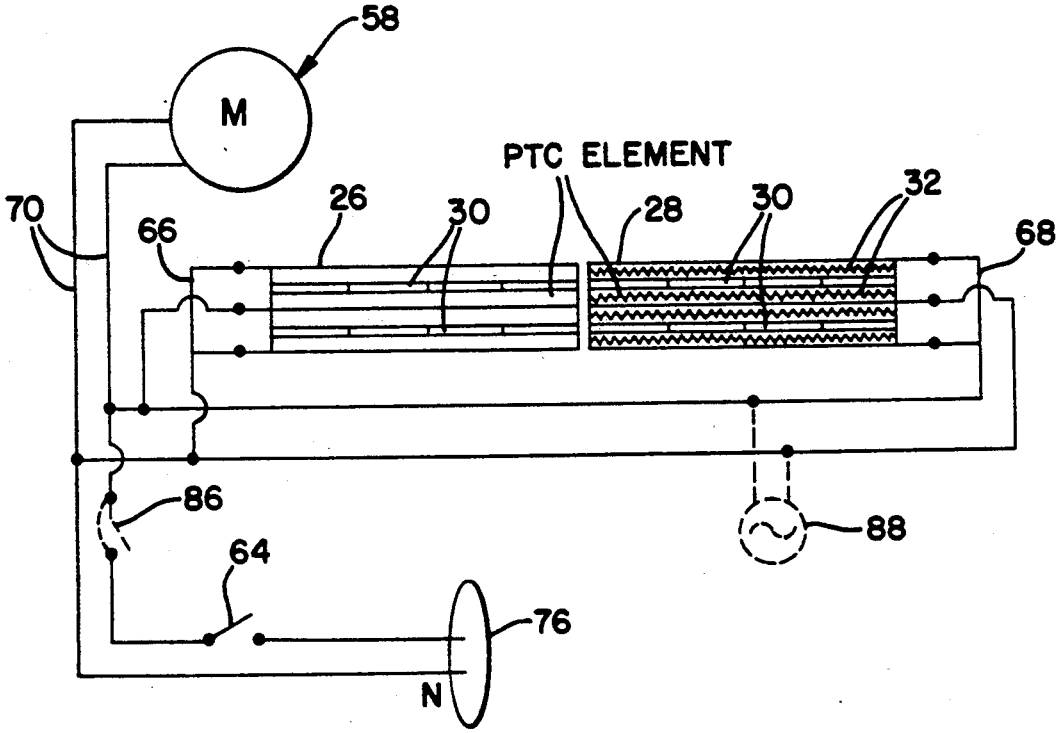
FIG. 7 is a schematic illustration of the electrical circuitry for the air heating device of the invention.
Figure 8:
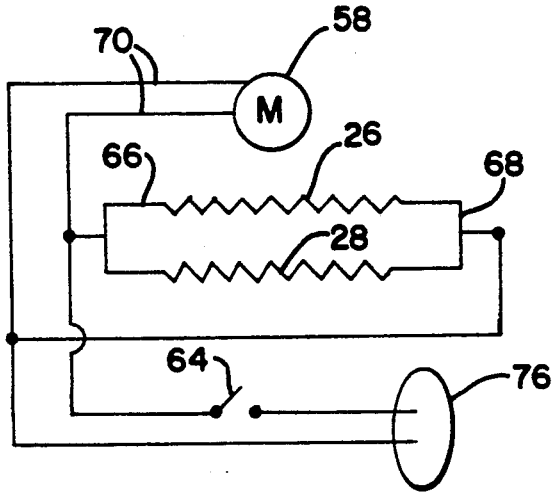
FIG. 8 is a simplified schematic view of the electrical circuitry of FIG. 7.

The heat transfer body 14 is internally divided into a pair of separate air paths 22 and 24. The air path 22 is simply an open duct, while the air path 24 includes a pair of PTC heating devices 26 and 28 (FIG. 7), each of which is composed of a plurality of conventional PTC heating elements or chips 30, separated by a finned area 32 or other appropriate means to allow through passage of air. Each of the PTC heating devices 26 and 28 is mounted on an appropriate support 34 within the heat transfer body 14.

An adjustable damper 36 is used to regulate airflow through the air paths 22 and 24. As explained above, the damper 36 also acts as a temperature regulating device, as will be described in greater detail below. The damper 36 is formed of a suitable material, such as high temperature plastic or metal, and is guided in a pair of slots 38 and 40 mounted in the heat transfer body 14 just above the PTC heating devices 26 and 28.

An arm 42 is used for controlling the relative position of the damper 36. The arm 42 includes a central slot 44 which is engaged upon a pair of upstanding guide posts 46 and 48 secured to the damper 36. A guide 50 is mounted on the arm 42, and includes a stop 52. The guide 50 may be made of Teflon or a similar low friction material to avoid sliding interference with the cover 16, as explained below. The arm 42 is capped with an operating knob 54 which is used for control of the arm 42, and consequentially the damper 36.

A blower assembly is used to provide airflow through the air heating device 10. The blower assembly is composed of a scroll blower 56 driven by a motor 58. The blower assembly is mounted in a housing 60 which is secured to the heat transfer body 14 by means of suitable mounting pegs and lock nuts 62, or similar mounting devices.

A microswitch 64 is used for initial control of the air heating device 10. In its right-most excursion, the stop 52 of the arm 42 engages the microswitch 64, deenerqizing power to both the blower motor 58 and PTC heating devices 26 and 28.

The PTC heating devices 26 and 28 each include wires 66 and 68 for energization, and the motor 58 similarly includes wires 70. All wires pass through a bushing 72 of a wire compartment 74 and thence to a power source 76 remote from the air heating device 10. The microswitch 64 is interposed in the supply line leading to the motor 58 and PTC heating devices 26 and 28, in a conventional fashion.

The cover 16 includes an upper air inlet grille 78 and a lower air outlet grille 80. The inlet grille 78 includes an air filter media 79 filtering air entering the air heating device 10. The arm 42 of the damper 36 extends through a slot 82 in the face of the cover 16. Appropriate indicia 84 may also be included on the cover 16 to readily indicate the direction to which the arm 42 must be shifted for increasing or decreasing the heat output of the air heating device 10.

Although unnecessary to proper operation of the air heating device 10, an alternate internal thermostat may be employed for controlling the PTC heating devices 26 and 28, and the blower motor 58. A thermostatic switch (not illustrated), may be appropriate located in the cover 16, accessible to the user. In addition, again although not necessary for proper operation of the air heating device 10, an alternate limit control 86 can be employed to deenergize the PTC heating devices 26 and 28 and blower motor 58 if any situation of abnormal operation occurred. Finally, a pilot light 88 may be provided through an opening in the cover 16 (not illustrated) to indicate when the PTC heating devices 26 and 28 are operating.

Figure 4:
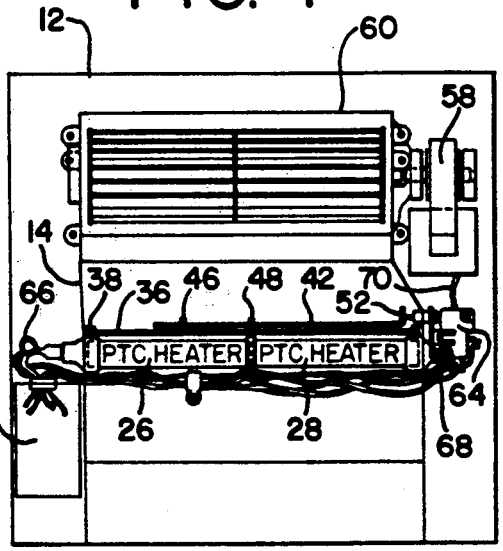
FIG. 4 is a view similar to FIG. 3, but with the front cover completely removed, and with all internal elements in place.
Figure 5A:
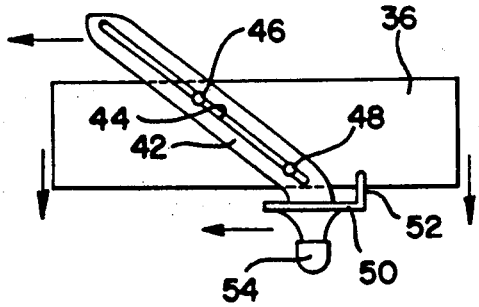
FIG. 5A is a schematic top plan illustration of the damper employed by the invention, showing substantially full opening of the damper for maximum heat output from the heating device.
Figure 5B:
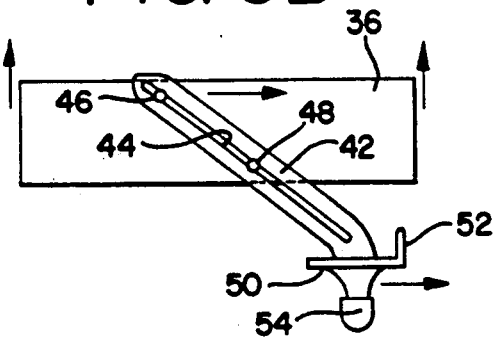
FIG. 5B is a view similar to that of FIG. 5A, but with the damper substantially fully closed to minimize heat output from the air heating device of the invention.

Operation of the air heating device 10 is governed by the position of the damper 36 which is controlled by the arm 42. With the arm 42 in its right-most position (FIGS. 4 and 5B), the stop 52 engages the microswitch 64, opening the electrical circuit to the PTC heating devices 26 and 28 and blower motor 58, preventing operation of the air heating device 10. The arm 42 protrudes through the slot 82, sandwiching the cover 16 between the guide 50 and the knob 54.

As the arm 42 is slid transversely to the left, the microswitch 64 is closed, energizing the PTC heating devices 26 and 28, and motor 58. Air therefore is drawn through the inlet air grille 78 by the scroll blower 56, and passes through the air paths 22 and 24, the proportion of air passing through the respective air paths depending on the position of the damper 36. Heated air then exits the air heating device 10 through the outlet air grille 80.

Figure 2:
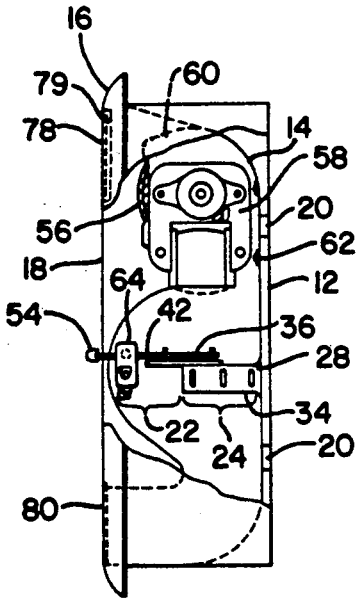
FIG. 2 is a side elevational view thereof, with portions broken away to illustrate detail.
Figure 3:
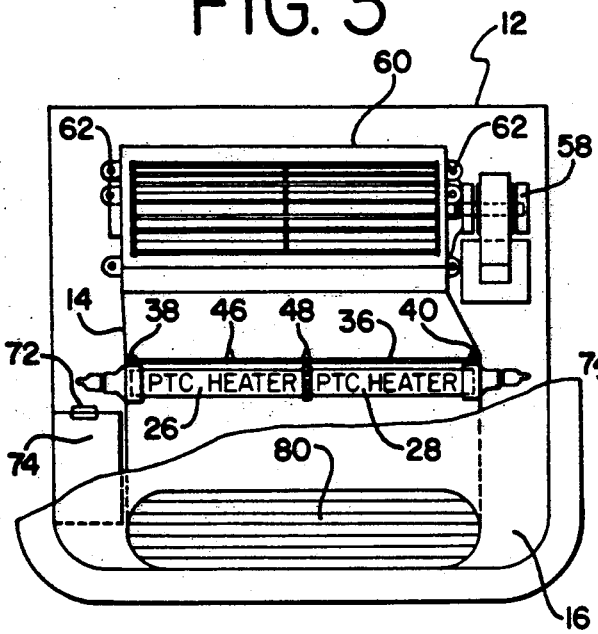
FIG. 3 is an elevational view similar to that of FIG. 1, but with portions of the front cover removed to illustrate detail, and also with certain elements omitted to simplify the drawing somewhat.
Figure 6:
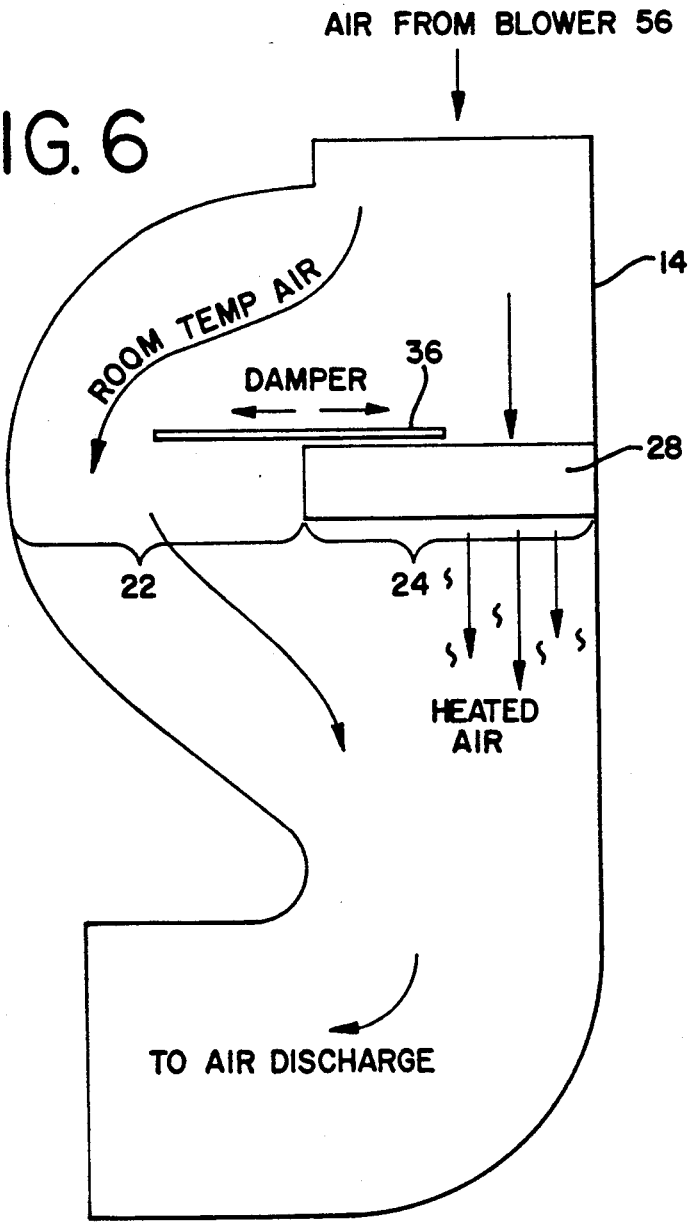
FIG. 6 is a schematic side elevational illustration of the airflow paths within the air heating device of the invention.

The position of the damper 36 governs the quantity of air heated. In the position shown in FIGS. 2 and 6, the damper 36 is midway across each of the air paths 22 and 24, thus allowing approximately half of the airflow through each air path. In the position shown in FIGS. 1 and 5A, the damper 36 is drawn to its forwardmost excursion, essentially completely covering the air path 22, and thus allowing airflow only through the air path 24. This is the position of maximum heat output, since all air is passing through the air path 24, past the energized PTC heating devices 26 and 28. Conversely, however, when the damper 36 is in the position shown in FIG. 5B, the damper 36 essentially covers most if not all of the air path 24, thus allowing most air to bypass the PTC heating devices 26 and 28. In that orientation, very little, if any, heating of air occurs before it exits through the outlet air grille 80. As explained above, because of the self-limiting nature of the PTC elements 30, overheating does not occur no matter what the position of the damper 36 in relation to the air paths 22 and 24.

While the air heating device 10 is shown in the form of a wall-type installation, it should be evident that, depending on the heat output of the device 10 and locations to be heated, the device 10 can be provided in a stand-alone orientation with ducting of heated air to locations to be heated. The form shown in the drawing figures is preferred.

ACHIEVEMENTS

By providing a pair of air paths, only one of which has heating elements therein, and a damper for controlling relative airflow through the two air paths, the present invention provides a unique manner of regulating airflow and heat output. Conventional heating devices require thermostating switches to turn heating elements on and off to prevent overheating, but in the present application, when the damper has been placed in one position, the heat output will remain constant so long as the damper remains in that position. No matter where the damper is located, air output from the heating device is constant since the blower motor is driven at a constant rate. This allows for designing the device to provide minimum air friction and noise.

Because the air paths are located centrally within the air heating device, and because the outlet grille is disposed at 90° relative to the air paths, heated air and bypassed air are blended within the device before being discharged through the outlet grille, providing for uniform heating.

Various changes can be made to the invention without departing from the spirit thereof or scope of the following claims.

What is claimed is:

1. An electric air heating device comprising a. a heat transfer body, b. means for inletting air into said body and means for outletting air from said body, c. heat transfer means located in said body, said heat transfer means comprising i. means defining a pair of separate and distinct air paths in said heat transfer body, ii. a fixed PTC heating means located in one of said air paths across said one air path, and iii. means proximate said PTC heating means and spaced a fixed distance therefrom for controlling airflow through said air paths, said airflow controlling means including an adjustable, shiftable regulator which when adjusted increases airflow in one of said air paths and decreases airflow in the other of said air paths, and d. means in said heat transfer body for supplying a constant fixed volume of air to said separate air paths.

2. An electric air heating device according to claim 1 in which said means for inletting air comprises an air grille.

3. An electric air heating device according to claim 2 in which said air grille includes an air filter media.

4. An electric air heating device according to claim 1 in which said means for outletting air comprises an air grille.

5. An electric air heating device according to claim 1 including a housing, said heat transfer body being mounted in said housing.

6. An electric air heating device according to claim 5 including means spacing said body from said housing.

7. An electric air heating device according to claim 6 in which said means spacing comprises a series of spaced, insulative isolation pads located between said body and said housing.

8. An electric air heating device according to claim 1 in which said PTC heating means comprises a plurality of PTC elements.

9. An electric air heating device according to claim 1 in which said adjustable regulator comprises a damper, and in which said airflow controlling means includes an arm extending from said damper for adjustment of said damper.

10. An electric air heating device according to claim 9 in which said air paths are located in a fore and aft relationship, and in which said damper is mounted for lateral movement from a first position preventing airflow in one air path and permitting full airflow in the other air path to a second position preventing airflow in the other air path and permitting full airflow in the one air path.

11. An electric air heating device according to claim 9 in which said damper is mounted for lateral movement in said heat transfer body across said air paths and in which said arm includes a longitudinal slot, said arm being slideably mounted on said damper on a pair of guide posts extending from said damper through said slot such that transverse movement of said arm creates lateral movement of said damper perpendicular to the direction of travel of said slot.

12. An electric air heating device according to claim 1 including means for energizing said PTC heating means and said means for supplying air.

13. An electric air heating device according to claim 12 in which said means for energizing comprises a switch.

14. An electric air heating device according to claim 13 including an arm extending from said regulator, said arm being mounted to activate said switch.

15. An electric air heating device according to claim 1 in which said means for supplying air comprises a scroll blower.

16. An electric air heating device according to claim 15 including means for driving said blower at a constant rate for establishing a fixed volume of airflow through said body.

* * * * *